US006520891B1

(12) United States Patent
Stephens, Jr.

(10) Patent No.: US 6,520,891 B1
(45) Date of Patent: Feb. 18, 2003

(54) TREADMILL WITH UPPER BODY EXERCISE MEANS

(76) Inventor: Charles H. Stephens, Jr., 10107 Grovecrest Ct., Richmond, VA (US) 23236

( * ) Notice: Subject to any disclaimer, the term of this patent is extended or adjusted under 35 U.S.C. 154(b) by 0 days.

(21) Appl. No.: 10/112,569

(22) Filed: Apr. 1, 2002

(51) Int. Cl.[7] ..... A63B 22/02
(52) U.S. Cl. ..... 482/54; 482/121
(58) Field of Search ..... 482/51, 54, 121, 482/122, 123, 129, 130, 133, 136, 137, 148

(56) References Cited

U.S. PATENT DOCUMENTS 5,110,117 A * 5/1992 Fisher et al. ..... 482/54
5,171,196 A * 12/1992 Lynch ..... 482/7
5,492,517 A 2/1996 Bostic et al.
5,595,556 A 1/1997 Dalebout et al.
5,632,708 A 5/1997 Wilkinson et al.
5,860,894 A 1/1999 Dalebout et al.
5,871,421 A 2/1999 Trulaske et al.
5,951,449 A * 9/1999 Oppriecht ..... 482/113

* cited by examiner

*Primary Examiner*—Stephen R. Crow
(74) *Attorney, Agent, or Firm*—Norman Rainer

(57) ABSTRACT

An exercise apparatus employing a treadmill of conventional design includes upper body exercise features involving a lever having a rearwardly disposed gripping handle and a forwardly disposed extremity pivotably secured to a stanchion of adjustable height. Reversibly extensible tether bands or springs extend between the lever and the stanchion. By changing the height of the stanchion, the gripping handle may be positioned at waist level, thereby permitting upward pulling exercise, or at shoulder level, permitting upward pushing exercise.

6 Claims, 3 Drawing Sheets

TREADMILL WITH UPPER BODY EXERCISE MEANS

BACKGROUND OF THE INVENTION

1. Field of the Invention

This invention relates to exercise machines, and, more particularly, to machines for performing both aerobic and anaerobic exercises.

2. Description of the Prior Art

One goal of exercise is to enhance the strength and endurance of skeletal muscles. Another goal is to enhance lung capacity and endurance of, for example, the heart and lungs.

Exercises are sometimes categorized according to their relative purpose or effectiveness in achieving a particular goal. For purposes of this application, those exercises most effective in strengthening skeletal muscles may be termed anaerobic or strength-conditioning exercises. Strength-conditioning exercises are also sometimes call weight-training exercises. Those which are most effective in enhancing cardiovascular performance or the condition of the heart and lungs may be termed aerobic exercises. It is usually desirable to included both aerobic and anaerobic exercises in an exercise program.

Aerobic exercises rely generally on rapid and extended repetitions of an exercise movement against low to moderate resistance. Running and jogging are examples of what are typically regarded as aerobic exercises. Treadmills and stepper-type machines are examples of machines for performing running, stepping or jogging-type exercises.

Anaerobic exercises for muscle conditioning are usually performed by making a relatively few repetitive movements or repetitions (e.g., 10–30) against high resistance. Typically, anaerobic exercises involve a more static type of exercise in which the user pushes or pulls against a force which can be selected or adjusted consistent with the user's desires. For example, the exerciser may work against gravitational resistance by lifting free weights, or by lifting weights against an arrangement of pulleys to develop increased strength. Weight machines are known which provide adjustable resistance for a selection of anaerobic exercises using different muscles and limbs. Such machines may include a bench portion so the user may recline to do, for example, press exercises, or sit to do, for example, leg lift exercises.

For many users, a home exercise apparatus greatly facilitates the regular performance of an exercise program. It is, furthermore, highly desirable to have a single machine useful for both anaerobic and aerobic conditioning. Exercise machines that combine both aerobic and anaerobic exercise functions are known. For example, U.S. Pat. No. 4,477,071 (Brown et. al.) discloses a rowing machine (aerobic) which can be reconfigured and used for performing anaerobic exercises. U.S. Pat. Nos. 4,796,881 and 4,750,736 (Watterson) both disclose a rowing exerciser with a weight bench structure for anaerobic or strength exercises. U.S. Pat. No. 4,705,267 (Jackson) discloses a machine having a weight bench portion, a bicycle wind trainer and a rowing machine.

Even though machines are known that can be reconfigured for use for both aerobic and anaerobic exercises, such machines have not in the past involved a relatively small or compact structure that can be easily converted while readily useful for aerobic exercises such as walking or jogging.

Motorized treadmills are a recognized machine for performing aerobic exercise. Various improvements to treadmills have been made to enhance their utility and their appeal, including inclination and speed adjustments, programmed and programmable exercise routines, shock absorption, pulse monitoring and safety switches.

U.S. Pat. No. 4,625,962 (Street) illustrates one such treadmill. It shows a treadmill with a cable pull apparatus to exercise the upper body and apparatus to develop muscles used in ski poling, canoeing or kayaking, and rowing.

Further illustrated in U.S. Pat. No. 4,869,493 (Johnston) is a conventional treadmill apparatus which includes an auxiliary upper body exercise unit and a seat which, in turn, may be installed on the treadmill in a forwardly-facing or rearwardly-facing fashion to be used in conjunction with the auxiliary upper body exercise unit.

Another treadmill apparatus is illustrated in U.S. Pat. No. 5,000,440 (Lynch) which combines a treadmill with an upper body muscle-stressing device. The user may use the treadmill independently of an exerciser which utilizes weights, lifted by the user.

A similar apparatus is illustrated in U.S. Pat. No. 5,104,119 (Lynch), which combines a treadmill with an upper body exercise device and monitor. Rather than use weights in the upper body exercise device, hydraulic/pneumatic cylinders, springs, elastic bands or other suitable variable resistance means are incorporated.

In U.S. Pat. No. 5,110,117 (Fisher et. al.), a treadmill is illustrated having movable handles to be grasped by the user for exercising the upper body of the user while walking on the treadmill belt. The device of the '117 patent employs spring-loaded handles pivotally mounted on each side of the treadmill belt. The handles also extend upwardly through the side surfaces of chassis adjacent the treadmill belt.

A similar-type treadmill is illustrated in U.S. Pat. No. 5,207,622 (Wilkerson et. al.) wherein the pivotally-mounted handles on each side of the treadmill belt incorporate adjustable resistance devices that incorporate resistance plates or disks to adjust the desired force for the user during the upper body exercises of the user.

Yet another treadmill-type exercise device is illustrated in U.S. Pat. No. 5,226,866 (Engel et. al.), which includes a treadmill, slidable foot restraints to simulate cross-country skiing, reciprocating, pivotable foot paddles connected to pneumatic cylinders or resistance mechanisms to simulate stair climbing and a pivotable torso support to assist balance of a person during exercise.

While such prior-art devices provide a treadmill type of apparatus which may include different types of upper body exercise, such devices do not provide sufficient flexibility and opportunity for a user to have available a broad range of aerobic and anaerobic exercises in one exercise apparatus. Such prior devices also rely upon complex structural features which are expensive and subject to malfunction. This is particularly the case with treadmill systems permitting arm exercise in upward pulling and pushing modes.

It is accordingly an object of the present invention to provide a treadmill apparatus equipped with arm exercise means.

It is a further object of this invention to provide an apparatus as in the foregoing object which enables the user to exert upward pulling and pushing force while on the treadmill.

It is another object of the present invention to provide an apparatus of the aforesaid nature wherein the elevation and force of said arm exercise means are adjustable.

It is a still further object of this invention to provide an apparatus of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by an exercise apparatus comprising:

a) a treadmill having a stationary base elongated upon a center axis between front and rear extremities and further bounded by opposed side portions, a controllably movable continuous belt embraced by said base, paired handrails extending upwardly from said side portions, and a control panel disposed upon first stanchion means upwardly extending from said front extremity, b) second stanchion means of adjustable height upwardly extending from said front extremity forwardly of said first stanchion means and centered upon said axis, said second stanchion means comprised of a stationary bottom member and a top member upwardly moveable from controlled engagement with said bottom member, and terminating in an upper extremity, c) an exercise lever having a rearwardly disposed extremity equipped with gripping means to accommodate two hands, and a forwardly disposed extremity pivotably secured to the upper extremity of the top member of said second stanchion means, and d) tensioning means extending between the top member of said second stanchion means and said exercise lever, said tensioning means being elongatable with a force proportionate to the extent of elongation.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
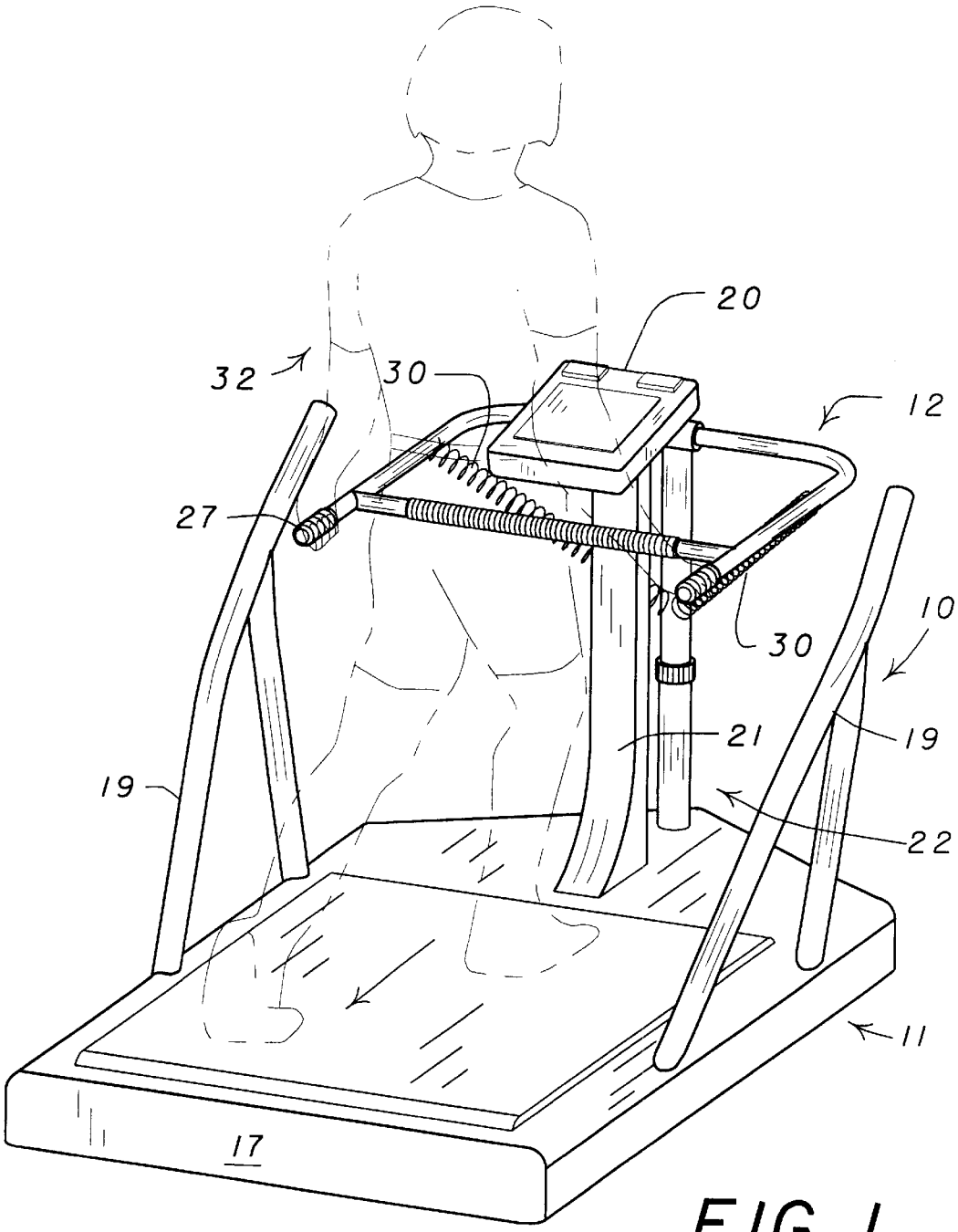
FIG. 1 is a perspective rear and top view of an embodiment of the apparatus of the present invention.
Figure 2:
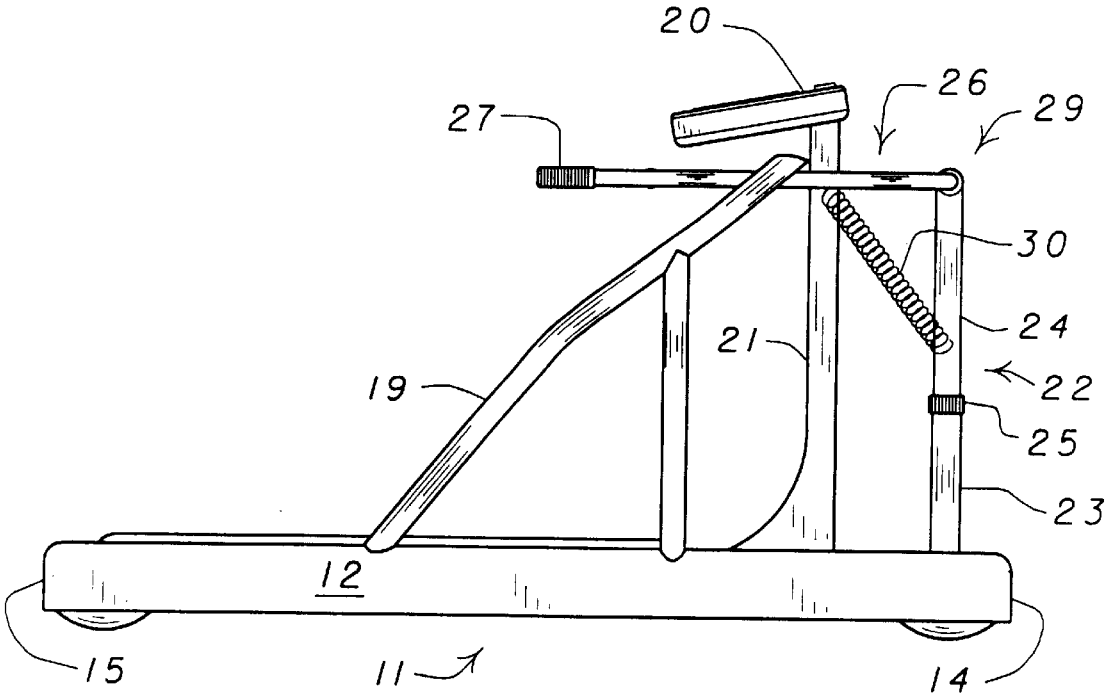
FIG. 2 is a side view of the embodiment of FIG. 1.
Figure 3:
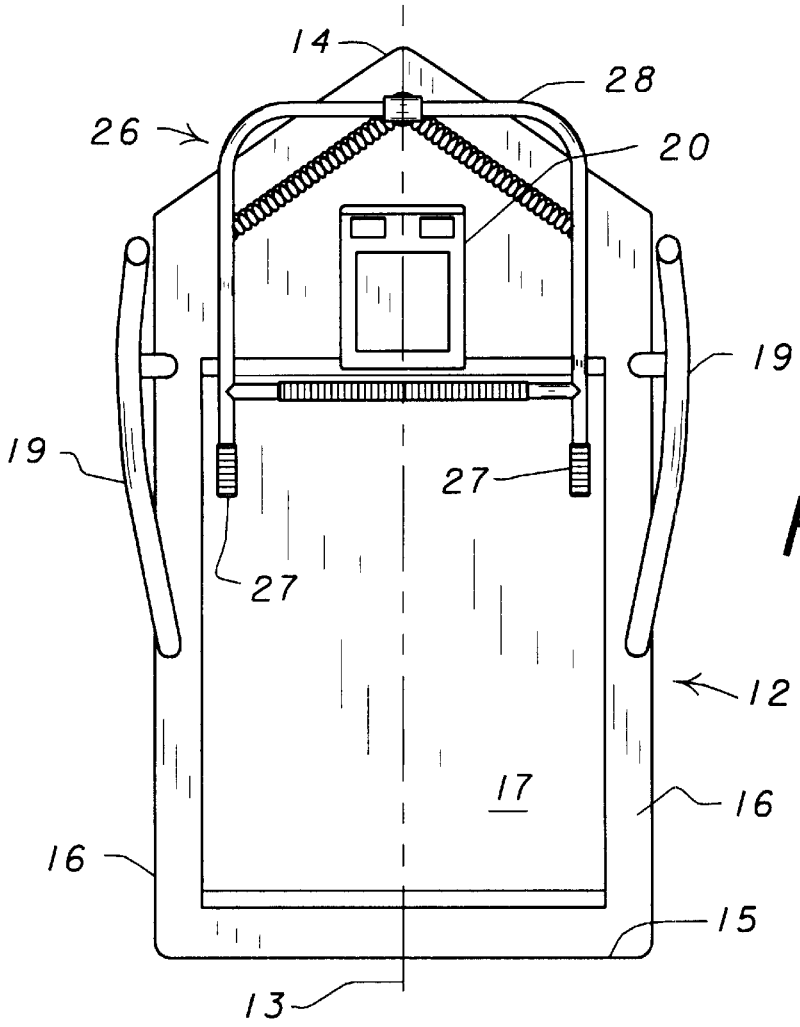
FIG. 3 is a top view of the embodiment of FIG. 1.
Figure 4:
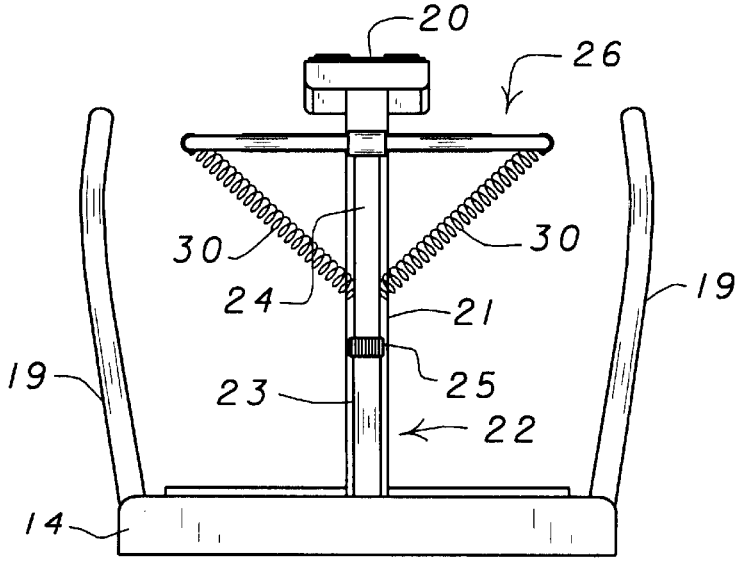
FIG. 4 is a front view.

Referring now to FIGS. 1–4, an embodiment of the exercise apparatus 10 of the present invention is shown comprised of treadmill 11 and arm exercise portion 12.

Treadmill 11 is of conventional construction, and is comprised of a stationary base 12 elongated upon center axis 13 between front and rear extremities, 14 and 15, respectively, and further bounded by opposed side portions 16. A controllably moveable belt 17 is embraced by said base in substantially horizontal disposition and adapted to move rearwardly. The speed of belt movement and its angle of inclination are adjustable by actuator means confined within base 12.

Paired stationary handrails 19 extend upwardly from side portions 16. A control and display panel 20 is disposed upon first stanchion means 21 upwardly extending from said front extremity. Said panel contains touch-control means for controlling the speed of the belt and its angle of inclination and the timed duration of an exercise session. Said panel may also display information such as belt speed and angle, duration of exercise, calories burned and heart rate.

A second stanchion means 22 of adjustable height is shown in the form of stationary bottom tube 23 centered upon axis 13 forwardly of said first stanchion, and top member 24 telescopically emergent upwardly from said bottom tube. Locking means 25 which may be in the form of a gripping collar, or an insertive lock pin, are employed to secure the position of top member 24.

An exercise lever 26 having rearwardly disposed gripping means 27 to accommodate the user's two hands, extends to a forward extremity 28 pivotally secured to the upper extremity 29 of top member 24 of said second stanchion means.

Tensioning means in the form of reversibly extensible tether bands 30 extend between top member 24 and said exercise lever. Said tether bands are of such nature that the amount of force required to raise said exercise lever is generally proportionate to the degree of extension of said bands as a manifestation of Hooke's law of physics. Accordingly, said tensioning means may involve one or several coil springs or resilient rubber belt or tube members. For example, one tether band may represent 5 pounds, another 25 pounds, another 100 pounds, etc.

In use, the exercising person 32, while positioned upon belt 17 in either moving or static mode, will grasp gripping means 27. When said gripping means are located below waist level, the exercise lever will be pulled upwardly either in the manner of lifting the handle of a wheelbarrow, or in a curling motion. When the gripping means are located at about shoulder level or above, by way of suitable positioning of top member 24, the exercise lever will be pushed upwardly as in a military press exercise.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An exercise apparatus comprising:

a) a treadmill having a stationary base elongated upon a center axis between front and rear extremities and further bounded by opposed side portions, a controllably movable continuous belt in substantially horizontal disposition embraced by said base, paired handrails extending upwardly from said side portions, and a control panel disposed upon first stanchion means upwardly extending from said front extremity, b) second stanchion means of adjustable height upwardly extending from said front extremity forwardly of said first stanchion means and centered upon said axis, said second stanchion means comprised of a stationary bottom member and a top member upwardly moveable from controlled engagement with said bottom member, and terminating in an upper extremity, c) an exercise lever having a rearwardly disposed extremity equipped with gripping means to accommodate two hands, and a forwardly disposed extremity pivotably secured to the upper extremity of the top member of said second stanchion means, and d) tensioning means extending between said second stanchion means and said exercise lever, said tensioning means being elongatable with a force proportionate to the extent of elongation.

2. The exercise apparatus of claim 1 wherein said tensioning means are removable for the purpose of changing the range of exercise force.

3. The exercise apparatus of claim 2 wherein the top member of said second stanchion means is telescopically emergent upwardly from said stationary bottom member.

4. The exercise apparatus of claim 3 wherein locking means are employed to secure the position of said top member with respect to said stationary bottom member.

5. The exercise apparatus of claim 2 wherein said tensioning means include at least one extensible resilient tether band.

6. The exercise apparatus of claim 5 wherein the elevation of said gripping means can be adjusted between waist height and shoulder height by virtue of adjustable height of said second stanchion means, thereby permitting upward pulling and pushing exercises, respectfully.

* * * * *